US011326804B2

(12) United States Patent
Takenaka et al.

(10) Patent No.: US 11,326,804 B2
(45) Date of Patent: May 10, 2022

(54) AIR-CONDITIONING SYSTEM

(71) Applicant: Mitsubishi Electric Corporation, Tokyo (JP)

(72) Inventors: Naofumi Takenaka, Tokyo (JP); Hiroki Washiyama, Tokyo (JP); Yuji Motomura, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 3 days.

(21) Appl. No.: 16/962,018

(22) PCT Filed: Feb. 6, 2018

(86) PCT No.: PCT/JP2018/003915
§ 371 (c)(1),
(2) Date: Jul. 14, 2020

(87) PCT Pub. No.: WO2019/155506
PCT Pub. Date: Aug. 15, 2019

(65) Prior Publication Data

US 2020/0400340 A1 Dec. 24, 2020

(51) Int. Cl.
*F24F 11/84* (2018.01)
*F24F 1/32* (2011.01)
*F25B 13/00* (2006.01)

(52) U.S. Cl.
CPC ..... *F24F 11/84* (2018.01); *F24F 1/32* (2013.01); *F25B 13/00* (2013.01)

(58) Field of Classification Search
CPC ..... F24F 11/84; F24F 1/32; F25B 13/00
See application file for complete search history.

(56) References Cited

U.S. PATENT DOCUMENTS 4,484,452 A * 11/1984 Houser, Jr. ..... F25B 13/00 62/149
2015/0020535 A1* 1/2015 Hatomura ..... F25B 13/00 62/160
2017/0191706 A1* 7/2017 Ogawa ..... F16K 11/076

FOREIGN PATENT DOCUMENTS

GB 2525791 A 11/2015
JP 2004-144457 A 5/2004
(Continued)

OTHER PUBLICATIONS

International Search Report of the International Searching Authority dated May 1, 2018 for the corresponding international application No. PCT/JP2018/003915 (and English translation).

*Primary Examiner* — Henry T Crenshaw
(74) *Attorney, Agent, or Firm* — Posz Law Group, PLC

(57) ABSTRACT

An air-conditioning system includes a plurality of indoor units; a relay unit including an intermediate heat exchanger configured to exchange heat between refrigerant and a heat medium; and a heat source unit configured to supply cooling energy or heating energy to each of the plurality of indoor units via the relay unit. The heat source unit and the relay unit are connected by a heat-source connection pipe through which the refrigerant flows, and the relay unit and the plurality of indoor units are connected by a load connection pipe through which the heat medium flows. The load connection pipe comprises a main pipe connecting between the relay unit and one of the indoor units provided at an end of the load connection pipe opposite to the relay unit. The main pipe has branch parts associated with the indoor units.

8 Claims, 4 Drawing Sheets

(56) References Cited

FOREIGN PATENT DOCUMENTS

| | | | | |
|---|---|---|---|---|
| JP | 2004-211998 | A | | 7/2004 |
| JP | 2009-144940 | A | | 7/2009 |
| JP | 2016-090178 | | * | 5/2016 |
| JP | 2016-090178 | A | | 5/2016 |
| JP | 2016-121853 | A | | 7/2016 |
| JP | 2017-072356 | A | | 4/2017 |
| WO | 2014/118953 | A1 | | 8/2014 |
| WO | 2016/009748 | A1 | | 1/2016 |
| WO | 2016/051606 | A1 | | 4/2016 |

* cited by examiner

AIR-CONDITIONING SYSTEM

CROSS REFERENCE TO RELATED APPLICATION

This application is a U.S. national stage application of International Application No. PCT/JP2018/003915, filed on Feb. 6, 2018, the contents of which are incorporated herein by reference.

TECHNICAL FIELD

The present disclosure relates to an air-conditioning system including a relay unit between a heat source unit and an indoor unit.

BACKGROUND

Hitherto, there is known an air-conditioning system in which a plurality of indoor units are connected to a heat source unit. In this air-conditioning system, refrigerant may circulate from the heat source unit to each indoor unit to transfer cooling energy or heating energy (see, for example, Patent Literature 1).

Further, reduction of refrigerant amounts is made obligatory by various regulations in recent years and the goal of reduction of refrigerant amounts tends to be stricter every year. Therefore, there has been developed an air-conditioning system in which heat generated by a heat source unit on a refrigerant circuit is supplied to each indoor unit on a heat medium circuit (see, for example, Patent Literature 2). In the air-conditioning system of Patent Literature 2, an intermediate heat exchanger configured to exchange heat between refrigerant flowing through the refrigerant circuit and a heat medium flowing through the heat medium circuit is provided in an outdoor unit.

Here, specific heat of the heat medium such as water is larger than specific heat of the refrigerant. That is, the temperature of the heat medium such as water is less changeable compared with the temperature of the refrigerant. Further, when the heat medium such as water and the refrigerant flow through pipes having the same diameter, greater power is required to convey the heat medium than is required to convey the refrigerant.

PATENT LITERATURE

Patent Literature 1: Japanese Unexamined Patent Application Publication No. 2009-144940

Patent Literature 2: Japanese Unexamined Patent Application Publication No. 2016-90178

In the air-conditioning system of Patent Literature 2, however, a heat medium pipe runs from the intermediate heat exchanger provided in the outdoor unit to points near the indoor units, and branches from the points toward the indoor units. Therefore, the pipe length increases. Thus, the heat medium that is relatively large in terms of specific heat and power required for flowing moves by a long distance. As a result, problems arise in that the operation efficiency of the entire system decreases and the amount of energy consumption increases.

SUMMARY

The air-conditioning system of the present disclosure has been made to overcome the problems described above and aims to provide an air-conditioning system in which the operation efficiency of the entire system is increased and energy saving is achieved.

An air-conditioning system according to an embodiment of the present disclosure includes a plurality of indoor units; a relay unit including an intermediate heat exchanger configured to exchange heat between refrigerant and a heat medium; and a heat source unit including a compressor and a heat source-side heat exchanger and configured to supply cooling energy or heating energy to each of the plurality of indoor units via the relay unit, wherein the heat source unit and the relay unit are connected by a heat-source connection pipe through which the refrigerant flows, wherein the relay unit and the plurality of indoor units are connected by a load connection pipe through which the heat medium flows, wherein the load connection pipe comprises a main pipe connecting between the relay unit and one of the indoor units provided at an end of the load connection pipe opposite to the relay unit, wherein the main pipe has branch parts associated with the indoor units other than the one of the indoor units provided at the end of the load connection pipe opposite to the relay unit among the plurality of indoor units, and wherein a length of the main pipe from a connection part connected to the relay unit to a first branch part, which is closest to the relay unit of the branch parts, is smaller than a length of the heat-source connection pipe.

According to the embodiment of the present disclosure, the length of the main pipe from the relay unit to the first branch part is smaller than the length of the heat-source connection pipe. Thus, the amount of the heat medium that is larger than the refrigerant in terms of specific heat and power required for flowing can be reduced. Accordingly, the operation efficiency of the entire system can be increased and energy saving can be achieved.

DETAILED DESCRIPTION

Embodiment 1

Figure 1:
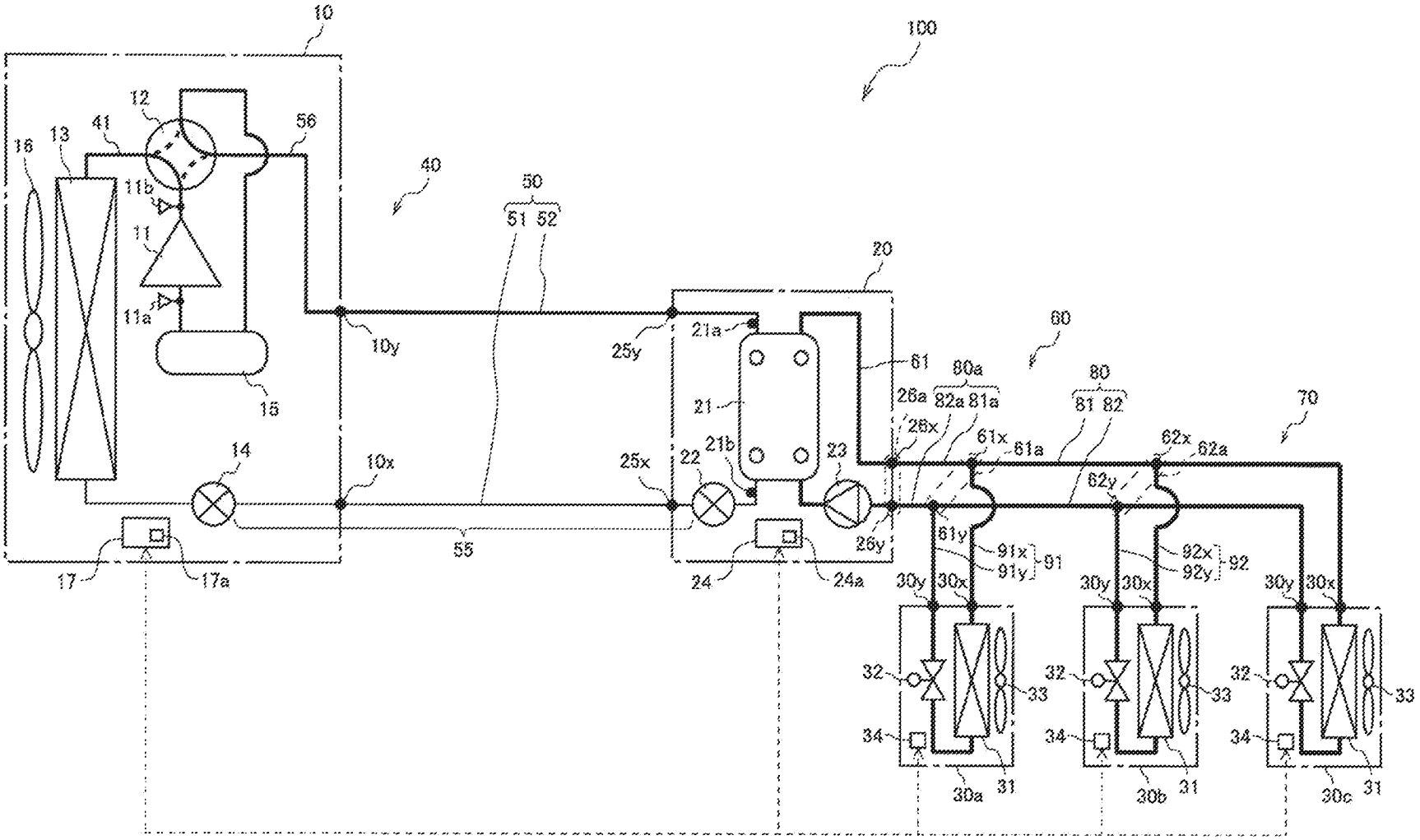
FIG. 1 is a circuit diagram exemplifying the structure of an air-conditioning system according to Embodiment 1 of the present disclosure.

FIG. 1 is a circuit diagram exemplifying the structure of an air-conditioning system according to Embodiment 1 of the present disclosure. As illustrated in FIG. 1, an air-conditioning system 100 includes a heat source unit 10, a relay unit 20, and a plurality of indoor units 30*a* to 30*c*. FIG. 1 exemplifies a case where the air-conditioning system 100 includes three indoor units 30*a* to 30*c*.

The heat source unit 10 supplies cooling energy or heating energy to each of the indoor units 30*a* to 30*c* via the relay unit 20. The heat source unit 10 includes a compressor 11, a four-way valve 12, a heat source-side heat exchanger 13, a heat source-side expansion device 14, and an accumulator 15. The heat source unit 10 further includes a heat source-side fan 16 and a heat source-side controller 17. The relay unit 20 includes an intermediate heat exchanger 21 configured to exchange heat between refrigerant and a heat medium, a relay unit expansion device 22, a pump 23, and a relay unit controller 24. Each of the indoor units 30*a* to 30*c* includes a load-side heat exchanger 31, a flow control valve 32, a load-side fan 33, and a load-side controller 34.

That is, in the air-conditioning system 100, the compressor 11, the four-way valve 12, the heat source-side heat exchanger 13, the heat source-side expansion device 14, the relay unit expansion device 22, the intermediate heat exchanger 21, and the accumulator 15 are connected via a refrigerant pipe 41 to form a refrigerant circuit 40 through which refrigerant circulates. Examples of the refrigerant that circulates through the refrigerant circuit 40 herein include single-component refrigerants such as R-22 and R-134a, near-azeotropic refrigerant mixtures such as R-410A and R-404A, and zeotropic refrigerant mixtures such as R-407C. Note that refrigerants such as $CF_3CF{=}CH_2$ having a double bond in the chemical formula and having a relatively low global warming potential, mixtures of those refrigerants, and natural refrigerants such as $CO_2$ and propane may be used as the refrigerant that circulates through the refrigerant circuit 40.

Further, in the air-conditioning system 100, the pump 23, the intermediate heat exchanger 21, and the load-side heat exchangers 31 and the flow control valves 32 of the indoor units 30*a* to 30*c* are connected via a heat medium pipe 61 to form a heat medium circuit 60 through which a heat medium circulates. Examples of the heat medium herein include water and brine.

The heat source unit 10 and the relay unit 20 are connected by a heat-source connection pipe 50 that constitutes the refrigerant pipe 41. The heat-source connection pipe 50 is constituted by a liquid-side connection pipe 51 and a gas-side connection pipe 52. The liquid-side connection pipe 51 constitutes a liquid pipe 55 of the refrigerant pipe 41 and connects between a connection part 10*x* of the heat source unit 10 and a connection part 25*x* of the relay unit 20. Here, the liquid pipe 55 connects between the heat source-side expansion device 14 and the relay unit expansion device 22. Liquid refrigerant or two-phase refrigerant flows through the liquid pipe 55. In Embodiment 1, two-phase refrigerant mainly flows through the liquid pipe 55. During a cooling operation, the liquid-side connection pipe 51 allows refrigerant flowing out of the heat source unit 10 to flow therethrough to the relay unit 20. During a heating operation, the liquid-side connection pipe 51 allows refrigerant flowing out of the relay unit 20 to flow therethrough to the heat source unit 10.

The gas-side connection pipe 52 constitutes a gas pipe 56 of the refrigerant pipe 41 and connects between a connection part 10*y* of the heat source unit 10 and a connection part 25*y* of the relay unit 20. In Embodiment 1, the gas pipe 56 connects between the intermediate heat exchanger 21 and the four-way valve 12. That is, the gas pipe 56 is constituted by a pipe connecting the four-way valve 12 to the connection part 10*y*, the gas-side connection pipe 52, and a pipe connecting the connection part 25*y* to the intermediate heat exchanger 21. During the cooling operation, the gas-side connection pipe 52 allows refrigerant flowing out of the relay unit 20 to flow therethrough to the heat source unit 10. During the heating operation, the gas-side connection pipe 52 allows the refrigerant flowing out of the heat source unit 10 to flow therethrough to the relay unit 20.

The relay unit 20 and each of the indoor units 30*a* to 30*c* are connected by a load connection pipe 70 that constitutes the heat medium pipe 61. The load connection pipe 70 includes a main pipe 80 connecting the relay unit 20 to an indoor unit provided at an end of the load connection pipe opposite to the relay unit 20. The main pipe 80 has branch parts associated with indoor units other than the indoor unit provided at the end of the load connection pipe opposite to the relay unit among the plurality of indoor units.

In Embodiment 1, the indoor unit 30*c* is provided at the end of the load connection pipe opposite to the relay unit 20. That is, the main pipe 80 connects between a connection part 26*x* of the relay unit 20 and a connection part 30*x* of the indoor unit 30*c* and a connection part 26*y* of the relay unit 20 to a connection part 30*y* of the indoor unit 30*c*. Further, the main pipe 80 has a first branch part 61*a* associated with the indoor unit 30*a* and a second branch part 62*a* associated with the indoor unit 30*b*. The length of a first main pipe 80*a* of the main pipe 80 from a connection part 26*a* connected to the relay unit 20 to the first branch part 61*a* closest to the relay unit 20 is smaller than the length of the heat-source connection pipe 50.

Here, the specific heat of the heat medium and power required for the heat medium to flow are larger than the specific heat of the refrigerant and power required for the refrigerant to flow. Therefore, the amount of the heat medium can be reduced by reducing the total length of the heat medium pipe 61. Thus, the operation efficiency of the entire system can be increased and energy saving can be achieved. Further, the reduction in the amount of the heat medium can lead to a reduction in the amount of heat to be supplied to the heat medium when the air-conditioning system 100 is activated. Thus, the activation time of the air-conditioning system 100 can be reduced. Note that the installation places of the indoor units are determined depending on, for example, the structure of a building and the layout of rooms and therefore the length of the heat medium pipe 61 in a range from the first branch part 61*a* cannot be adjusted prior to works on site. In this respect, in Embodiment 1, the length of the first main pipe 80*a*, which can be adjusted prior to works on site, is set smaller than the length of the heat-source connection pipe 50. Thus, the total length of the heat medium pipe 61 is reduced.

More specifically, the main pipe 80 includes an departure main pipe 81 that allows the heat medium flowing out of the relay unit 20 to flow therethrough toward each of the indoor units 30*a* to 30*c*, and a return main pipe 82 that allows the heat medium flowing out of each of the indoor units 30*a* to 30*c* to flow therethrough toward the relay unit 20. The departure main pipe 81 connects between the connection part 26*x* and each connection part 30*x*. The departure main pipe 81 has a first departure branch part 61*x* and a second departure branch part 62*x*. The return main pipe 82 connects between the connection part 26*y* and each connection part 30*y*. The return main pipe 82 has a first return branch part 61*y* and a second return branch part 62*y*.

That is, the first branch part 61*a* includes the first departure branch part 61*x* provided on the departure main pipe 81 and the first return branch part 61*y* provided on the return main pipe 82. The second branch part 62*a* includes the second departure branch part 62*x* provided on the departure main pipe 81 and the second return branch part 62*y* provided on the return main pipe 82. Further, the first main pipe 80*a* includes a first departure main pipe 81*a*, which is a part of the departure main pipe 81 and connects between the connection part 26*x* and the first departure branch part 61*x*, and a first return main pipe 82*a*, which is a part of the return main pipe 82 and connects between the connection part 26*y* and the first return branch part 61*y*. Further, the total length of the first departure main pipe 81*a* and the first return main pipe 82*a* is smaller than the total length of the liquid-side connection pipe 51 and the gas-side connection pipe 52. For example, both the first departure main pipe 81*a* and the first return main pipe 82*a* may be shorter than the liquid-side connection pipe 51 and the gas-side connection pipe 52.

The load connection pipe 70 includes a branch pipe 91 connecting the main pipe 80 to the indoor unit 30*a* and a branch pipe 92 connecting the main pipe 80 to the indoor unit 30*b*. The branch pipe 91 is connected to the main pipe 80 at the first branch part 61*a*. The branch pipe 92 is connected to the main pipe 80 at the second branch part 62*a*.

The branch pipe 91 includes an departure branch pipe 91*x* connecting the first departure branch part 61*x* to the connection part 30*x* of the indoor unit 30*a*, and a return branch pipe 91*y* connecting the connection part 30*y* of the indoor unit 30*a* to the first return branch part 61*y*. The branch pipe 92 includes an departure branch pipe 92*x* connecting the second departure branch part 62*x* to the connection part 30*x* of the indoor unit 30*b*, and a return branch pipe 92*y* connecting the connection part 30*y* of the indoor unit 30*b* to the second return branch part 62*y*.

For example, the compressor 11 includes a compressor motor (not illustrated) to be driven by an inverter to suck and compress refrigerant. The four-way valve 12 is connected to the compressor 11 and is controlled by the heat source-side controller 17 to switch refrigerant passages. The four-way valve 12 selects a solid-line passage in FIG. 1 during the cooling operation in which cooling energy is supplied to each of the indoor units 30*a* to 30*c*. On the other hand, the four-way valve 12 selects a broken-line passage in FIG. 1 during the heating operation in which heating energy is supplied to each of the indoor units 30*a* to 30*c*.

For example, the heat source-side heat exchanger 13 is a fin-and-tube heat exchanger and exchanges heat between outdoor air and refrigerant flowing through the refrigerant circuit 40. The heat source-side heat exchanger 13 functions as a condenser during the cooling operation, that is, when the heat source unit 10 serves as a cooling energy source. On the other hand, the heat source-side heat exchanger 13 functions as an evaporator during the heating operation, that is, when the heat source unit 10 serves as a heating energy source. For example, the heat source-side expansion device 14 is an electronic expansion valve and expands refrigerant by reducing a pressure of the refrigerant. The heat source-side expansion device 14 is provided in downstream of the heat source-side heat exchanger 13 during the cooling operation. During the cooling operation, the heat source-side expansion device 14 is controlled by the heat source-side controller 17 to generate two-phase refrigerant by reducing a pressure of high-pressure refrigerant flowing into the heat source-side expansion device 14 from the heat source-side heat exchanger 13. The accumulator 15 is provided in upstream of the compressor 11 and accumulates surplus refrigerant to suppress inflow of liquid refrigerant into the compressor 11. The heat source-side fan 16 sends outdoor air to the heat source-side heat exchanger 13.

For example, the intermediate heat exchanger 21 is a plate heat exchanger and is connected between the refrigerant circuit 40 and the heat medium circuit 60. The intermediate heat exchanger 21 exchanges heat between the refrigerant circulating through the refrigerant circuit 40 and the heat medium circulating through the heat medium circuit 60. The intermediate heat exchanger 21 functions as an evaporator during the cooling operation and as a condenser during the heating operation. For example, the relay unit expansion device 22 is an electronic expansion valve and expands refrigerant by reducing a pressure of the refrigerant. The relay unit expansion device 22 is provided in downstream of the intermediate heat exchanger 21 during the heating operation. During the heating operation, the relay unit expansion device 22 is controlled by the relay unit controller 24 to generate two-phase refrigerant by reducing a pressure of high-pressure refrigerant flowing into the relay unit expansion device 22 from the intermediate heat exchanger 21.

For example, the pump 23 includes a motor (not illustrated) to be driven by an inverter. The pump 23 is driven by the motor serving as a power source to circulate the heat medium through the heat medium circuit 60. That is, the pump 23 is controlled by the relay unit controller 24 to apply a pressure by which the heat medium circulates through the heat medium circuit 60.

For example, the load-side heat exchanger 31 is a fin-and-tube heat exchanger and exchanges heat between indoor air and the heat medium flowing through the heat medium circuit 60. For example, the flow control valve 32 is an electronic expansion valve and is controlled by the load-side controller 34 to control the amount of the heat medium to be caused to flow into the load-side heat exchanger 31. It is appropriate that the flow control valve 32 be provided in downstream of the load-side heat exchanger 31.

The load-side fan 33 sends indoor air to the load-side heat exchanger 31. The load-side controller 34 controls the opening degree of the flow control valve 32. The load-side controller 34 of each of the indoor units 30*a* to 30*c* can perform data communication with the heat source-side controller 17 of the heat source unit 10 and with the relay unit controller 24 of the relay unit 20.

The heat source unit 10 includes a suction pressure sensor 11*a* and a discharge pressure sensor 11*b*. The suction pressure sensor 11*a* is provided on a suction side of the compressor 11 and measures a suction pressure Ps, which is a pressure of refrigerant to be sucked into the compressor 11. The discharge pressure sensor 11*b* is provided on a discharge side of the compressor 11 and measures a discharge pressure Pd, which is a pressure of refrigerant discharged from the compressor 11. The suction pressure sensor 11*a* and the discharge pressure sensor 11*b* output measurement data to the heat source-side controller 17.

The relay unit 20 includes a first temperature sensor 21*a* and a second temperature sensor 21*b*. The first temperature sensor 21*a* measures a first temperature, which is a temperature of refrigerant flowing through a passage between the intermediate heat exchanger 21 and the compressor 11. In Embodiment 1, the first temperature sensor 21*a* is provided in the relay unit 20 between the intermediate heat exchanger 21 and the four-way valve 12. The second temperature sensor 21*b* is provided between the intermediate heat exchanger 21 and the relay unit expansion device 22 and measures a second temperature, which is a temperature of refrigerant flowing through a passage between the intermediate heat exchanger 21 and the relay unit expansion device 22.

The first temperature sensor 21*a* is provided in downstream of the intermediate heat exchanger 21 during the cooling operation. The second temperature sensor 21*b* is provided in downstream of the intermediate heat exchanger 21 during the heating operation. The first temperature sensor 21*a* and the second temperature sensor 21*b* output measurement data to the relay unit controller 24.

The heat source-side controller 17 controls actions of the compressor 11, the four-way valve 12, and the heat source-side expansion device 14. The heat source-side controller 17 includes a heat source-side storage 17*a* that stores, for example, data for use in various arithmetic operations. The heat source-side controller 17 can perform data communication with the relay unit controller 24 of the relay unit 20 and with the load-side controller 34 of each of the indoor units 30*a* to 30*c*.

During the cooling operation, the heat source-side controller 17 determines a degree of superheat at an outlet of an evaporator by using the suction pressure Ps measured by the suction pressure sensor 11*a* and the first temperature measured by the first temperature sensor 21*a*. The degree of superheat at the outlet of the evaporator is a degree of superheat at an outlet of the intermediate heat exchanger 21 that functions as the evaporator during the cooling operation, and is hereinafter referred to as a degree of superheat. More specifically, the heat source-side controller 17 determines an evaporating temperature by converting the suction pressure Ps into a saturation temperature during the cooling operation. The heat source-side controller 17 acquires the first temperature via the relay unit controller 24. The heat source-side controller 17 determines the degree of superheat by subtracting the evaporating temperature from the first temperature.

The heat source-side controller 17 controls the opening degree of the heat source-side expansion device 14 based on the determined degree of superheat. When the degree of superheat is higher than a reference degree of superheat, the heat source-side controller 17 performs control to increase the opening degree of the heat source-side expansion device 14. When the degree of superheat is lower than the reference degree of superheat, the heat source-side controller 17 performs control to reduce the opening degree of the heat source-side expansion device 14. For example, the reference degree of superheat is determined through tests conducted for an actual device. When the degree of superheat equals the reference degree of superheat, the refrigerant flowing into the liquid pipe 55 from the heat source-side expansion device 14 is in a two-phase state. For example, the reference degree of superheat is set to 1 degree Celsius to 2 degrees Celsius but may be changed as appropriate depending on characteristics of the refrigerant circuit 40 and an installation environment of the air-conditioning system 100.

More specifically, the heat source-side storage 17*a* may store, for example, a heat source-side opening degree deriving function for deriving the opening degree of the heat source-side expansion device 14 with the degree of superheat as a variable. In this case, the heat source-side controller 17 can determine the opening degree of the heat source-side expansion device 14 that is associated with the degree of superheat by substituting the degree of superheat into the heat source-side opening degree deriving function. Further, the heat source-side storage 17*a* may store a heat source-side opening degree table in which the degree of superheat is associated with the opening degree of the heat source-side expansion device 14. In this case, the heat source-side controller 17 can determine the opening degree of the heat source-side expansion device 14 that is associated with the degree of superheat by referring to the degree of superheat in the heat source-side opening degree table. Further, it is appropriate that the heat source-side controller 17 adjust the opening degree of the heat source-side expansion device 14 to the determined opening degree.

Further, if the reference degree of superheat is stored in the heat source-side storage 17*a*, the heat source-side controller 17 may determine a difference between the degree of superheat and the reference degree of superheat and control the opening degree of the heat source-side expansion device 14 based on the determined difference. In this case, the heat source-side opening degree deriving function is a function in which the difference between the degree of superheat and the reference degree of superheat is used as a variable. Similarly, in the heat source-side opening degree table, the difference is associated with the opening degree of the heat source-side expansion device 14. Here, the heat source-side opening degree deriving function and the heat source-side opening degree table may be provided so that an amount of adjustment for the opening degree of the heat source-side expansion device 14 is derived instead of the opening degree of the heat source-side expansion device 14.

The relay unit controller 24 controls actions of the relay unit expansion device 22 and the pump 23. The relay unit controller 24 includes a relay unit storage 24*a* that stores, for example, data for use in various arithmetic operations. The relay unit controller 24 can perform data communication with the heat source-side controller 17 of the heat source unit 10 and with the load-side controller 34 of each of the indoor units 30*a* to 30*c*.

During the heating operation, the relay unit controller 24 determines a degree of subcooling at an outlet of a condenser by using the discharge pressure Pd measured by the discharge pressure sensor 11*b* and the second temperature measured by the second temperature sensor 21*b*. The degree of subcooling at the outlet of the condenser is a degree of subcooling at an outlet of the intermediate heat exchanger 21 that functions as the condenser during the heating operation, and is hereinafter referred to as a degree of subcooling. More specifically, the relay unit controller 24 acquires the discharge pressure Pd via the heat source-side controller 17 during the heating operation and determines a condensing temperature by converting the acquired discharge pressure Pd into a saturation temperature. The relay unit controller 24 acquires the second temperature from the second temperature sensor 21*b*. The relay unit controller 24 determines the degree of subcooling by subtracting the second temperature from the condensing temperature.

The relay unit controller 24 controls the opening degree of the relay unit expansion device 22 based on the determined degree of subcooling. When the degree of subcooling is higher than a reference degree of subcooling, the relay unit controller 24 performs control to increase the opening degree of the relay unit expansion device 22. When the degree of subcooling is lower than the reference degree of subcooling, the relay unit controller 24 performs control to reduce the opening degree of the relay unit expansion device 22. For example, the reference degree of subcooling is determined through tests conducted for an actual device. When the degree of subcooling equals the reference degree of subcooling, the refrigerant flowing into the liquid pipe 55 from the relay unit expansion device 22 is in a two-phase state. For example, the reference degree of subcooling is set to 5 degrees Celsius to 6 degrees Celsius but may be changed as appropriate depending on the characteristics of the refrigerant circuit 40 and the installation environment of the air-conditioning system 100.

More specifically, the relay unit storage 24*a* may store, for example, a relay unit opening degree deriving function for deriving the opening degree of the relay unit expansion device 22 with the degree of subcooling as a variable. In this case, the relay unit controller 24 can determine the opening degree of the relay unit expansion device 22 that is associated with the degree of subcooling by substituting the degree of subcooling into the relay unit opening degree deriving function. Further, the relay unit storage 24*a* may store a relay unit opening degree table in which the degree of subcooling is associated with the opening degree of the relay unit expansion device 22. In this case, the relay unit controller 24 can determine the opening degree of the relay unit expansion device 22 that is associated with the degree of subcooling by referring to the degree of subcooling in the relay unit opening degree table. Further, it is appropriate that the relay unit controller 24 adjust the opening degree of the relay unit expansion device 22 to the determined opening degree.

Further, if the reference degree of subcooling is stored in the relay unit storage 24*a*, the relay unit controller 24 may determine a difference between the degree of subcooling and the reference degree of subcooling and control the opening degree of the relay unit expansion device 22 based on the determined difference. In this case, the relay unit opening degree deriving function is a function in which the difference between the degree of subcooling and the reference degree of subcooling is used as a variable. Similarly, in the relay unit opening degree table, the difference is associated with the opening degree of the relay unit expansion device 22. Here, the relay unit opening degree deriving function and the relay unit opening degree table may be provided so that an amount of adjustment for the opening degree of the relay unit expansion device 22 is derived.

The heat source-side controller 17, the relay unit controller 24, and the load-side controller 34 of each of the indoor units 30*a* to 30*c* can be constituted by a processor such as a microcomputer, and software that implements the functions described above in cooperation with the processor. Note that the heat source-side controller 17, the relay unit controller 24, and the load-side controller 34 of each of the indoor units 30*a* to 30*c* may include hardware such as a circuit device that partially or entirely implements the functions described above.

Figure 2:
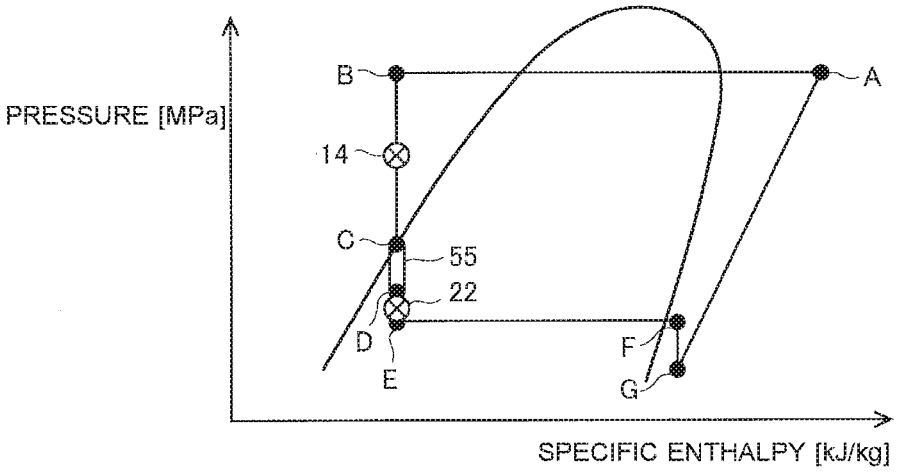
FIG. 2 is a p-h diagram illustrating states of refrigerant during a cooling operation in a refrigerant circuit of FIG. 1.
Figure 3:
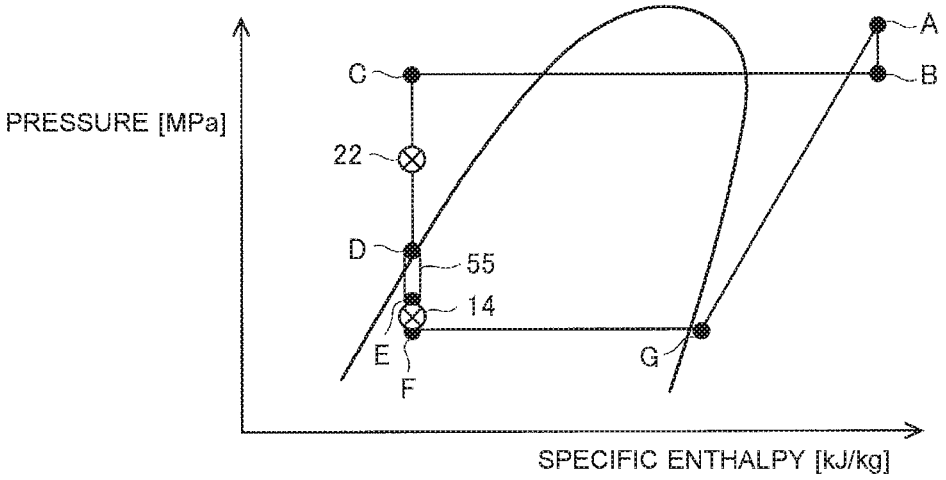
FIG. 3 is a p-h diagram illustrating states of refrigerant during a heating operation in the refrigerant circuit of FIG. 1.

FIG. 2 is a p-h diagram illustrating states of refrigerant during the cooling operation in the refrigerant circuit of FIG. 1. FIG. 3 is a p-h diagram illustrating states of refrigerant during the heating operation in the refrigerant circuit of FIG. 1. In the p-h diagrams of FIG. 2 and FIG. 3, the horizontal axis represents specific enthalpy and the vertical axis represents pressure. Further, in the p-h diagrams of FIG. 2 and FIG. 3, symbols representing the heat source-side expansion device 14, the liquid pipe 55, and the relay unit expansion device 22 are placed at points associated with changes of the state of refrigerant in the heat source-side expansion device 14, the liquid pipe 55, and the relay unit expansion device 22, respectively. Actions of the refrigerant circuit 40 in the air-conditioning system 100 are described with reference to FIG. 2 and FIG. 3.

First, an action of the refrigerant circuit 40 during the cooling operation is described with reference to FIG. 2. In Embodiment 1, the heat source-side controller 17 controls the opening degree of the heat source-side expansion device 14 during the cooling operation based on the degree of superheat of refrigerant flowing out of the heat source-side heat exchanger 13 so that the refrigerant flowing out of the heat source-side expansion device 14 is in a two-phase state. During the cooling operation, the relay unit controller 24 opens the relay unit expansion device 22. The relay unit controller 24 may maximize the opening degree of the relay unit expansion device 22 during the cooling operation.

High-temperature and high-pressure gas refrigerant discharged from the compressor 11 (point A in FIG. 2) flows into the heat source-side heat exchanger 13 via the four-way valve 12. During the cooling operation, the heat source-side heat exchanger 13 functions as the condenser. That is, the heat source-side heat exchanger 13 exchanges heat between the refrigerant flowing through the heat source-side heat exchanger 13 and outdoor air sent by the heat source-side fan 16, and condensing heat of the refrigerant is released into the outdoor air. Thus, the refrigerant flowing into the heat source-side heat exchanger 13 is condensed into high-pressure liquid refrigerant (point B in FIG. 2).

The high-pressure liquid refrigerant flowing out of the heat source-side heat exchanger 13 flows into the heat source-side expansion device 14 and the pressure of the refrigerant is reduced. Thus, the refrigerant turns into medium-pressure two-phase refrigerant having a pressure lower than a high-pressure-side pressure of the refrigerant circuit 40 and higher than a low-pressure-side pressure of the refrigerant circuit 40 (point C in FIG. 2). The medium-pressure two-phase refrigerant flowing out of the heat source-side expansion device 14 flows through the liquid pipe 55 and then through the relay unit expansion device 22. The pressure of the refrigerant flowing through the liquid pipe 55 and the relay unit expansion device 22 is reduced by pressure loss in the liquid pipe 55 and the relay unit expansion device 22 and the refrigerant turns into low-pressure two-phase refrigerant (point D and point E in FIG. 2).

The low-pressure two-phase refrigerant flowing through the relay unit expansion device 22 flows into the intermediate heat exchanger 21. The intermediate heat exchanger 21 exchanges heat between the heat medium and the refrigerant flowing through the intermediate heat exchanger 21. During the cooling operation, the intermediate heat exchanger 21 functions as the evaporator. That is, the refrigerant flowing into the intermediate heat exchanger 21 is evaporated into low-pressure gas refrigerant (point F in FIG. 2). On the other hand, the heat medium flowing into the intermediate heat exchanger 21 is cooled by a heat removing action of the refrigerant.

The low-pressure gas refrigerant evaporated by the intermediate heat exchanger 21 flows through the gas pipe 56 and the four-way valve 12 and the pressure of the refrigerant is reduced by pressure loss. Then, the refrigerant is sucked into the compressor 11 (point G in FIG. 2). The low-pressure gas refrigerant sucked into the compressor 11 is compressed into high-temperature and high-pressure gas refrigerant (point A in FIG. 2). During the cooling operation, the sequential cycle described above is repeated.

Next, an action of the refrigerant circuit 40 during the heating operation is described with reference to FIG. 3. During the heating operation, the heat source-side controller 17 operates the four-way valve 12 so that the passage is switched to the broken-line passage in FIG. 1. Thus, high-temperature and high-pressure refrigerant discharged from the compressor 11 flows into the intermediate heat exchanger 21 via the heat-source connection pipe 50. During the heating operation, the heat source-side controller 17 opens the heat source-side expansion device 14. The heat source-side controller 17 may maximize the opening degree of the heat source-side expansion device 14 during the heating operation. Further, the relay unit controller 24 controls the opening degree of the relay unit expansion device 22 during the heating operation based on the degree of subcooling of the refrigerant flowing out of the intermediate heat exchanger 21 so that the refrigerant flowing out of the relay unit expansion device 22 is in a two-phase state.

That is, the high-temperature and high-pressure gas refrigerant discharged from the compressor 11 (point A in FIG. 3) flows through the four-way valve 12 and the gas pipe 56 and the pressure of the refrigerant is reduced by pressure loss. Then, the refrigerant flows into the intermediate heat exchanger 21 (point B in FIG. 3). During the cooling operation, the intermediate heat exchanger 21 functions as the condenser. That is, the intermediate heat exchanger 21 exchanges heat between the heat medium and the refrigerant flowing through the intermediate heat exchanger 21, and condensing heat of the refrigerant is transferred to the heat medium. Thus, the refrigerant flowing into the intermediate heat exchanger 21 is condensed into high-pressure liquid refrigerant (point C in FIG. 3). Note that the heat medium flowing into the intermediate heat exchanger 21 is heated by a heat rejecting action of the refrigerant.

The high-pressure liquid refrigerant condensed by the intermediate heat exchanger 21 flows into the relay unit expansion device 22 and the pressure of the refrigerant is reduced. Thus, the refrigerant turns into medium-pressure two-phase refrigerant (point D in FIG. 3). The medium-pressure two-phase refrigerant flowing out of the relay unit expansion device 22 flows through the liquid pipe 55 and through the fully open heat source-side expansion device 14. The pressure of the refrigerant flowing through the liquid pipe 55 and the heat source-side expansion device 14 is reduced by pressure loss in the liquid pipe 55 and the heat source-side expansion device 14 and the refrigerant turns into low-pressure two-phase refrigerant (point E and point F in FIG. 3).

The low-pressure two-phase refrigerant flowing through the heat source-side expansion device 14 flows into the heat source-side heat exchanger 13. During the heating operation, the heat source-side heat exchanger 13 functions as the evaporator. That is, the heat source-side heat exchanger 13 exchanges heat between the refrigerant flowing through the heat source-side heat exchanger 13 and outdoor air sent by the heat source-side fan 16. Thus, the refrigerant flowing into the heat source-side heat exchanger 13 is evaporated into low-pressure gas refrigerant (point G in FIG. 3). The low-pressure gas refrigerant flowing out of the heat source-side heat exchanger 13 is sucked into the compressor 11 through the four-way valve 12 and is compressed into high-temperature and high-pressure gas refrigerant (point A in FIG. 3). During the heating operation, the sequential cycle described above is repeated.

Here, in the air-conditioning system 100, the relay unit 20 is disposed as close to the indoor units as possible so that the total length of the heat medium pipe 61 decreases. Therefore, the amount of the heat medium is reduced. Thus, the total length of the refrigerant pipe 41 is larger than that in a case where the relay unit 20 is disposed closer to the heat source unit 10. In this respect, in the air-conditioning system 100, the refrigerant in the liquid pipe 55 is in the two-phase state during both the cooling operation and the heating operation as described above. That is, according to the air-conditioning system 100, the density of the refrigerant in the refrigerant pipe 41 can be reduced and therefore the amount of refrigerant to be charged into the refrigerant pipe 41 can be reduced.

As described above, in the air-conditioning system 100 of Embodiment 1, the length of the first main pipe 80*a* of the main pipe 80 from the relay unit 20 to the first branch part 61*a* is smaller than the length of the heat-source connection pipe 50. Thus, the amount of the heat medium that is larger than the refrigerant in terms of specific heat and power required for flowing can be reduced. Accordingly, the operation efficiency of the entire system can be increased and energy saving can be achieved.

That is, in the air-conditioning system 100, the total length of the first departure main pipe 81*a* and the first return main pipe 82*a* is smaller than the total length of the liquid-side connection pipe 51 and the gas-side connection pipe 52. Therefore, the amount of the heat medium can be reduced to the extent corresponding to the reduction in the length of the heat medium pipe 61 of the heat medium circuit 60. Thus, the amount of heat to be supplied to the heat medium can be reduced and therefore the activation time can be reduced. Further, the power required for the heat medium to flow by the pump 23 can be reduced and the operation efficiency of the entire system can be increased.

Further, the diameter of the heat medium pipe through which the heat medium such as water circulates is larger than the diameter of the refrigerant pipe through which the refrigerant circulates. Therefore, the cost per unit length is higher in the heat medium pipe than in the refrigerant pipe and the installation cost is also higher in the heat medium circuit 60 than in the refrigerant circuit 40. Further, the pipe length from each branch part of the main pipe of the heat medium pipe to each indoor unit cannot be set in advance because the pipe length is determined during works on site. In this respect, in the air-conditioning system 100, the length of the main pipe 80 from the relay unit 20 to the first branch part 61*a* is smaller than the length of the heat-source connection pipe 50. Thus, the costs for materials and other costs can be reduced.

In addition, in the air-conditioning system 100, the relay unit 20 including the intermediate heat exchanger 21 is interposed between the heat source unit 10 and each of the indoor units 30*a* to 30*c*. Therefore, the refrigerant amount and the activation time can be reduced compared with those in the structure of, for example, Patent Literature 1 in which the refrigerant circulates in a wide range from the heat source unit to each indoor unit.

Further, during the cooling operation in which the heat source-side heat exchanger 13 functions as the condenser, the refrigerant to be caused to flow into the relay unit 20 is brought into the two-phase state by the heat source-side expansion device 14. More specifically, when the degree of superheat at the outlet of the intermediate heat exchanger 21 that functions as the evaporator is higher than the reference degree of superheat, the heat source-side controller 17 performs control to increase the opening degree of the heat source-side expansion device 14. When the degree of superheat at the outlet of the intermediate heat exchanger 21 that functions as the evaporator is lower than the reference degree of superheat, on the other hand, the heat source-side controller 17 performs control to reduce the opening degree of the heat source-side expansion device 14. With this structure, the refrigerant flowing from the heat source-side expansion device 14 into the liquid pipe 55 is in the two-phase state and therefore the density of the refrigerant can be reduced. Thus, the refrigerant charge amount can be reduced. That is, the volume of gas refrigerant is larger than the volume of liquid refrigerant and therefore the refrigerant amount can be reduced to the extent corresponding to the gas refrigerant in the two-phase gas-liquid refrigerant compared with the refrigerant amount in a case where liquid refrigerant flows through the liquid pipe 55.

Further, during the heating operation in which the intermediate heat exchanger 21 functions as the condenser, the refrigerant to be caused to flow into the heat source unit 10 is brought into the two-phase state by the relay unit expansion device 22. More specifically, when the degree of subcooling at the outlet of the intermediate heat exchanger 21 that functions as the condenser is higher than the reference degree of subcooling, the relay unit controller 24 performs control to increase the opening degree of the relay unit expansion device 22. Further, when the degree of subcooling at the outlet of the intermediate heat exchanger 21 that functions as the condenser is lower than the reference degree of subcooling, the relay unit controller 24 performs control to reduce the opening degree of the relay unit expansion device 22. With this structure, the refrigerant flowing from the relay unit expansion device 22 into the liquid pipe 55 is in the two-phase state and therefore the density of the refrigerant can be reduced. Thus, the refrigerant charge amount can be reduced.

That is, in the air-conditioning system 100, the refrigerant in the liquid pipe 55 is in the two-phase state during both the cooling operation and the heating operation. Therefore, the refrigerant amount can be reduced compared with that in the case where liquid refrigerant flows through the liquid pipe 55. Thus, according to the air-conditioning system 100, the amount of flow of the heat medium can be reduced by reducing the amount of heat to be supplied to the heat medium, and the amount of flow of the refrigerant can be reduced by reducing the amount of heat to be supplied to the refrigerant. Thus, the operation efficiency of the entire system can be improved and energy saving can be achieved.

Embodiment 2

Figure 4:
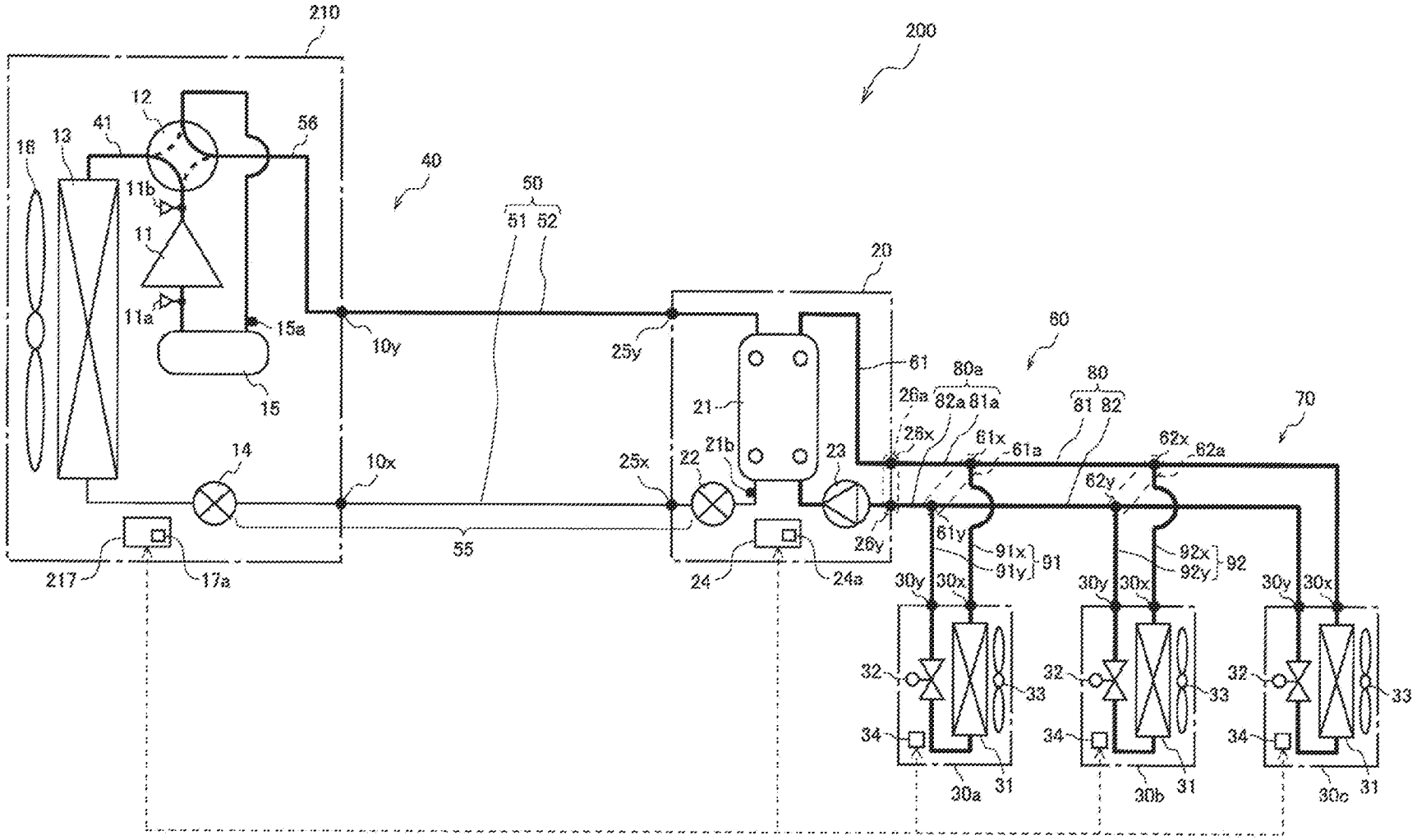
FIG. 4 is a circuit diagram exemplifying the structure of an air-conditioning system according to Embodiment 2 of the present disclosure.

FIG. 4 is a circuit diagram exemplifying the structure of an air-conditioning system according to Embodiment 2 of the present disclosure. An air-conditioning system 200 of Embodiment 2 differs from the air-conditioning system 100 of Embodiment 1 in terms of disposition of a part of the sensors. Components equivalent to those of Embodiment 1 are represented by the same reference signs and description thereof is omitted.

As illustrated in FIG. 4, the air-conditioning system 200 includes, in place of the first temperature sensor 21*a*, a first temperature sensor 15*a* provided in upstream of the accumulator 15 in a heat source unit 210. The first temperature sensor 15*a* outputs the measured first temperature to a heat source-side controller 217.

That is, the heat source-side controller 217 determines an evaporating temperature by converting the suction pressure Ps measured by the suction pressure sensor 11*a* into a saturation temperature during the cooling operation. Further, the heat source-side controller 217 directly acquires the first temperature from the first temperature sensor 15*a*. Then, the heat source-side controller 217 determines the degree of superheat at the outlet of the evaporator by subtracting the evaporating temperature from the first temperature. The other structure of the heat source-side controller 217 is similar to that of the heat source-side controller 17 of Embodiment 1.

Here, in the air-conditioning system 100 of Embodiment 1, the heat source-side controller 17 acquires the first temperature from the first temperature sensor 21*a* disposed in the relay unit 20. However, a part of the refrigerant pipe 41 between the intermediate heat exchanger 21 and the accumulator 15 is exposed to, for example, outdoor air and therefore the refrigerant temperature changes while the refrigerant is flowing through this part. Thus, when the degree of superheat is determined by using the first temperature measured by the first temperature sensor 21*a*, a deviation may occur in the degree of superheat.

In this respect, in Embodiment 2, the heat source-side controller 217 determines the degree of superheat by using the first temperature measured by the first temperature sensor 15*a* provided in the upstream of the accumulator 15. Thus, according to the air-conditioning system 200 of Embodiment 2, the degree of superheat can be determined with higher accuracy and therefore a low-energy operation can be achieved in consideration of loss of heat removal or rejection in the pipe between the intermediate heat exchanger 21 and the accumulator 15.

Further, in the air-conditioning system 200 of Embodiment 2, the amount of the heat medium that is larger than the refrigerant in terms of specific heat and power required for flowing can be reduced similarly to the air-conditioning system 100 of Embodiment 1. Thus, the operation efficiency of the entire system can be increased and energy saving can be achieved. Other advantages are similar to those of Embodiment 1.

Embodiment 3

Figure 5:
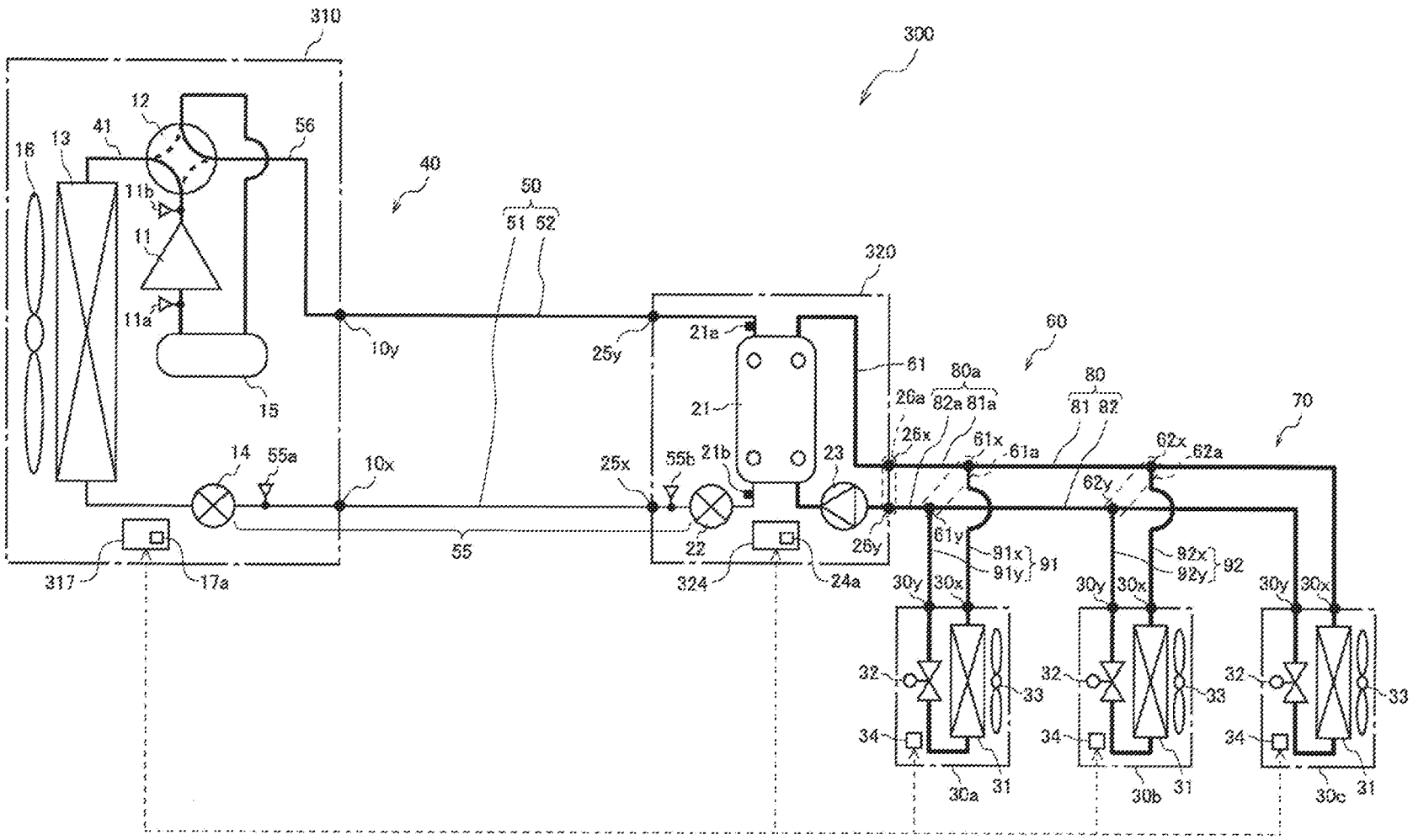
FIG. 5 is a circuit diagram exemplifying the structure of an air-conditioning system according to Embodiment 3 of the present disclosure.

FIG. 5 is a circuit diagram exemplifying the structure of an air-conditioning system according to Embodiment 3 of the present disclosure. An air-conditioning system 300 of Embodiment 3 differs from the air-conditioning systems of Embodiments 1 and 2 in terms of the structures of the sensors configured to measure various types of data. Components equivalent to those of Embodiments 1 and 2 are represented by the same reference signs and description thereof is omitted.

As illustrated in FIG. 5, the air-conditioning system 300 includes a first pressure sensor 55*a* and a second pressure sensor 55*b*. The first pressure sensor 55*a* is provided on the liquid pipe 55 in a heat source unit 310 and measures a first pressure $Pm_1$ of refrigerant flowing through the liquid pipe 55. The first pressure sensor 55*a* outputs the measured first pressure $Pm_1$ to a heat source-side controller 317. The second pressure sensor 55*b* is provided on the liquid pipe 55 in a relay unit 320 and measures a second pressure Pmt of the refrigerant flowing through the liquid pipe 55. The second pressure sensor 55*b* outputs the measured second temperature to a relay unit controller 324.

During the cooling operation, the heat source-side controller 317 controls the opening degree of the heat source-side expansion device 14 based on the first pressure $Pm_1$ measured by the first pressure sensor 55*a*. When the first pressure $Pm_1$ is lower than a first reference pressure, the heat source-side controller 317 performs control to increase the opening degree of the heat source-side expansion device 14. When the first pressure $Pm_1$ is higher than the first reference pressure, the heat source-side controller 317 performs control to reduce the opening degree of the heat source-side expansion device 14. For example, the first reference pressure is determined through tests conducted for an actual device. When the first pressure $Pm_1$ equals the first reference pressure, the refrigerant flowing into the liquid pipe 55 from the heat source-side expansion device 14 is in a two-phase state. The first reference pressure may be changed as appropriate depending on, for example, the characteristics of the refrigerant circuit 40 and an installation environment of the air-conditioning system 300.

More specifically, the heat source-side storage 17*a* may store, for example, a heat source-side opening degree deriving function for deriving the opening degree of the heat source-side expansion device 14 with the first pressure $Pm_1$ as a variable. In this case, the heat source-side controller 317 can determine the opening degree of the heat source-side expansion device 14 that is associated with the first pressure $Pm_1$ by substituting the first pressure $Pm_1$ into the heat source-side opening degree deriving function. Further, the heat source-side storage 17*a* may store a heat source-side opening degree table in which the first pressure $Pm_1$ is associated with the opening degree of the heat source-side expansion device 14. In this case, the heat source-side controller 317 can determine the opening degree of the heat source-side expansion device 14 that is associated with the first pressure $Pm_1$ by referring to the first pressure $Pm_1$ in the heat source-side opening degree table. Further, it is appropriate that the heat source-side controller 317 adjust the opening degree of the heat source-side expansion device 14 to the determined opening degree.

Further, if the first reference pressure is stored in the heat source-side storage 17*a*, the heat source-side controller 317 may determine a difference between the first pressure $Pm_1$ and the first reference pressure and control the opening degree of the heat source-side expansion device 14 based on the determined difference. In this case, the heat source-side opening degree deriving function is a function in which the difference between the first pressure $Pm_1$ and the first reference pressure is used as a variable. Similarly, in the heat source-side opening degree table, the difference is associated with the opening degree of the heat source-side expansion device 14. The heat source-side opening degree deriving function and the heat source-side opening degree table may be provided so that an amount of adjustment for the opening degree of the heat source-side expansion device 14 is derived instead of the opening degree of the heat source-side expansion device 14. The other structure of the heat source-side controller 317 is similar to that of the heat source-side controller 17 of Embodiment 1.

During the heating operation, the relay unit controller 324 controls the opening degree of the relay unit expansion device 22 based on the second pressure $Pm_2$ measured by the second pressure sensor 55*b*. When the second pressure $Pm_2$ is lower than a second reference pressure, the relay unit controller 324 performs control to increase the opening degree of the relay unit expansion device 22. When the second pressure $Pm_2$ is higher than the second reference pressure, the relay unit controller 324 performs control to reduce the opening degree of the relay unit expansion device 22. For example, the second reference pressure is determined through tests conducted for an actual device. When the second pressure $Pm_2$ equals the second reference pressure, the refrigerant flowing into the liquid pipe 55 from the relay unit expansion device 22 is in a two-phase state. The second reference pressure may be changed as appropriate depending on, for example, the characteristics of the refrigerant circuit 40 and the installation environment of the air-conditioning system 300.

More specifically, the relay unit storage 24*a* may store, for example, a relay unit opening degree deriving function for deriving the opening degree of the relay unit expansion device 22 with the second pressure $Pm_2$ as a variable. In this case, the relay unit controller 324 can determine the opening degree of the relay unit expansion device 22 that is associated with the second pressure $Pm_2$ by substituting the second pressure $Pm_2$ into the relay unit opening degree deriving function. Further, the relay unit storage 24*a* may store a relay unit opening degree table in which the second pressure $Pm_2$ is associated with the opening degree of the relay unit expansion device 22. In this case, the relay unit controller 324 can determine the opening degree of the relay unit expansion device 22 that is associated with the second pressure $Pm_2$ by referring to the second pressure $Pm_2$ in the relay unit opening degree table. Further, it is appropriate that the relay unit controller 324 adjust the opening degree of the relay unit expansion device 22 to the determined opening degree.

Further, if the second reference pressure is stored in the relay unit storage 24*a*, the relay unit controller 324 may determine a difference between the second pressure $Pm_2$ and the second reference pressure and control the opening degree of the relay unit expansion device 22 based on the determined difference. In this case, the relay unit opening degree deriving function is a function in which the difference between the second pressure $Pm_2$ and the second reference pressure is used as a variable. Similarly, in the relay unit opening degree table, the difference is associated with the opening degree of the relay unit expansion device 22. The relay unit opening degree deriving function and the relay unit opening degree table may be provided so that an amount of adjustment for the opening degree of the relay unit expansion device 22 is derived. The other structure of the relay unit controller 324 is similar to that of relay unit controller 24 of Embodiment 1.

As described above, in the air-conditioning system 300 of Embodiment 3, the amount of the heat medium that is larger than the refrigerant in terms of specific heat and power required for flowing can be reduced similarly to Embodiments 1 and 2. Thus, the operation efficiency of the entire system can be increased and energy saving can be achieved.

Further, in the air-conditioning system 300, the refrigerant to be caused to flow into the relay unit 20 is brought into the two-phase state by the heat source-side expansion device 14 during the cooling operation, and the refrigerant to be caused to flow into the heat source unit 10 is brought into the two-phase state by the relay unit expansion device 22 during the heating operation. Thus, the refrigerant amount can also be reduced in the air-conditioning system 300 compared with that in the case where liquid refrigerant flows through the liquid pipe 55. Other advantages are similar to those of Embodiments 1 and 2.

Incidentally, in Embodiment 3, description is made of the exemplary case where the opening degree of the heat source-side expansion device 14 is adjusted based on the first pressure $Pm_1$ and the opening degree of the relay unit expansion device 22 is adjusted based on the second pressure $Pm_2$. However, the adjustment is not limited to that in this case. For example, during the cooling operation, the heat source-side controller 317 may control the opening degree of the heat source-side expansion device 14 based on a pressure difference obtained by subtracting the first pressure $Pm_1$ from the discharge pressure Pd. At this time, it is appropriate that the relay unit controller 324 control the opening degree of the relay unit expansion device 22 based on the degree of superheat at the outlet of the evaporator. Further, during the heating operation, the opening degree of the heat source-side expansion device 14 may be controlled based on a pressure difference obtained by subtracting the suction pressure Ps from the second pressure $Pm_2$. At this time, it is appropriate that the relay unit controller 324 control the opening degree of the relay unit expansion device 22 based on the degree of subcooling at the outlet of the condenser. With this structure, the density of the refrigerant in the liquid pipe 55 can be made constant irrespective of the operating condition of the air-conditioning system. Thus, it is possible to suppress a decrease in performance due to a change in the refrigerant amount in the liquid pipe 55.

Embodiments 1 to 3 are preferred specific examples of the air-conditioning system and the technical scope of the present disclosure is not limited to Embodiments 1 to 3. For example, in each of the air-conditioning systems of Embodiments 1 to 3, the relay unit controller of the relay unit may perform centralized control over the entire system. More specifically, in the case of Embodiment 1, during the cooling operation, the relay unit controller 24 may determine the degree of superheat by using the suction pressure Ps and the first temperature and control the opening degree of the heat source-side expansion device 14 based on the determined degree of superheat. That is, the relay unit controller 24 may determine the opening degree of the heat source-side expansion device 14 that is associated with the determined degree of superheat and transmit a control signal showing the determined opening degree to the heat source-side controller 17, thereby controlling the opening degree of the heat source-side expansion device 14 via the heat source-side controller 17. In the cases of Embodiments 2 and 3, it is appropriate to employ a structure similar to the structure described above. When this structure is employed in the case of Embodiment 2, the relay unit controller 24 needs to acquire the first temperature measured by the first temperature sensor 15*a* from the heat source unit 210 via the heat source-side controller 217. In the case of Embodiment 1, on the other hand, the relay unit controller 24 can directly acquire the first temperature measured by the first temperature sensor 21*a*. Thus, the control can be simplified in the case where the structure described above is applied to Embodiment 1 than in the case where the structure described above is applied to Embodiment 2.

In Embodiments 1 to 3, description is made of the exemplary heat source units 10, 210, and 310 capable of supplying both cooling energy and heating energy by switching the refrigerant passages with the four-way valve 12. However, the heat source unit is not limited thereto. Each of the heat source units 10, 210, and 310 may supply cooling energy or heating energy without the four-way valve 12. That is, each of the air-conditioning systems 100, 200, and 300 may perform the cooling operation or the heating operation. Further, each of the air-conditioning systems 100, 200, and 300 may perform a cooling and heating simultaneous operation by selecting individual operating conditions of the indoor units.

Further, in Embodiments 1 to 3, description is made of the exemplary case where each of the air-conditioning systems 100, 200, and 300 includes three indoor units. However, the air-conditioning system is not limited thereto. Each of the air-conditioning systems 100, 200, and 300 may include two indoor units or may also include four or more indoor units. Note that, if each of the air-conditioning systems 100, 200, and 300 includes two indoor units, only the first branch part is associated with the indoor unit other than the indoor unit provided at the end of the load connection pipe opposite to the relay unit.

The invention claimed is:

1. An air-conditioning system, comprising:

a plurality of indoor units;

a relay unit including an intermediate heat exchanger configured to exchange heat between refrigerant and a heat medium; and a heat source unit including a compressor and a heat source-side heat exchanger and configured to supply cooling energy or heating energy to each of the plurality of indoor units via the relay unit, wherein the heat source unit and the relay unit are connected by a heat-source connection pipe through which the refrigerant flows, wherein the relay unit and the plurality of indoor units are connected by a load connection pipe through which the heat medium flows, wherein the load connection pipe comprises a main pipe connecting between the relay unit and one of the indoor units provided at an end of the load connection pipe opposite to the relay unit, wherein the main pipe has branch parts associated with the indoor units other than the one of the indoor units provided at the end of the load connection pipe opposite to the relay unit among the plurality of indoor units, and wherein a length of the main pipe from a connection part connected to the relay unit to a first branch part, which is closest to the relay unit of the branch parts, is smaller than a length of the heat-source connection pipe, wherein the heat source unit comprises the compressor, the heat source-side heat exchanger, and a heat source-side expansion device provided downstream of the heat source-side heat exchanger during a cooling operation in which the heat source-side heat exchanger functions as a condenser, wherein the heat source-side expansion device is configured such that the refrigerant to be caused to flow into the relay unit is brought into a two-phase state during the cooling operation, wherein the relay unit comprises a relay unit expansion device provided downstream of the intermediate heat exchanger during a heating operation in which the intermediate heat exchanger functions as a condenser, and wherein the relay unit expansion device is configured such that the refrigerant to be caused to flow into the heat source unit is brought into a two-phase state during the heating operation.

2. The air-conditioning system of claim 1, wherein the compressor, the heat source-side heat exchanger, and the intermediate heat exchanger are connected via a refrigerant pipe to form a refrigerant circuit through which the refrigerant circulates, wherein the heat-source connection pipe comprises:

a liquid-side connection pipe connecting between a connection part of the heat source unit and a connection part of the relay unit, on a liquid pipe of the refrigerant pipe; and a gas-side connection pipe connecting between a connection part of the heat source unit and a connection part of the relay unit, on a gas pipe of the refrigerant pipe, wherein the main pipe includes:

a departure main pipe that allows the heat medium flowing out of the relay unit to flow therethrough toward each of the plurality of indoor units; and a return main pipe that allows the heat medium flowing out of each of the plurality of indoor units to flow therethrough toward the relay unit, wherein the first branch part includes:

a first departure branch part provided on the departure main pipe; and a first return branch part provided on the return main pipe, wherein the departure main pipe comprises a first departure main pipe connecting between the first departure branch part and the connection part connected to the relay unit, wherein the return main pipe comprises a first return main pipe connecting between the first return branch part and the connection part connected to the relay unit, and wherein a total length of the first departure main pipe and the first return main pipe is smaller than a total length of the liquid-side connection pipe and the gas-side connection pipe.

3. The air-conditioning system of claim 1, wherein the heat source unit comprises a heat source-side controller configured to control an opening degree of the heat source-side expansion device, and wherein the heat source-side controller is configured to:

perform control to increase the opening degree of the heat source-side expansion device when a degree of superheat at an outlet of the intermediate heat exchanger that functions as an evaporator is higher than a reference degree of superheat; and perform control to reduce the opening degree of the heat source-side expansion device when the degree of superheat is lower than the reference degree of superheat.

4. The air-conditioning system of claim 3, further comprising:

a suction pressure sensor configured to measure a suction pressure, which is a pressure of the refrigerant to be sucked into the compressor; and a first temperature sensor configured to measure a first temperature, which is a temperature of the refrigerant flowing through a passage between the intermediate heat exchanger and the compressor, wherein the heat source-side controller determines the degree of superheat by using the suction pressure and the first temperature.

5. The air-conditioning system of claim 4, wherein the heat source unit comprises an accumulator upstream of the compressor, and wherein the first temperature sensor is provided in the heat source unit, upstream of the accumulator.

6. The air-conditioning system of claim 1, wherein the relay unit comprises a relay unit controller configured to control an opening degree of the relay unit expansion device, and wherein the relay unit controller is configured to:

perform control to increase the opening degree of the relay unit expansion device when a degree of subcooling at an outlet of the intermediate heat exchanger that functions as the condenser is higher than a reference degree of subcooling; and perform control to reduce the opening degree of the relay unit expansion device when the degree of subcooling is lower than the reference degree of subcooling.

7. The air-conditioning system of claim 6, further comprising:

a discharge pressure sensor configured to measure a discharge pressure, which is a pressure of the refrigerant discharged from the compressor; and a second temperature sensor configured to measure a second temperature, which is a temperature of the refrigerant flowing through a passage between the intermediate heat exchanger and the relay unit expansion device, wherein the relay unit controller determines the degree of subcooling by using the discharge pressure and the second temperature.

8. The air-conditioning system of claim 1, wherein each of the plurality of indoor units includes a load-side heat exchanger and a flow control valve, and wherein a pump, the intermediate heat exchanger, and the load-side heat exchanger and the flow control valve of each of the plurality of indoor units are connected via the load connection pipe to form a heat medium circuit through which the heat medium circulates by the pump.

* * * * *